US006510407B1

(12) United States Patent
Wang

(10) Patent No.: US 6,510,407 B1
(45) Date of Patent: Jan. 21, 2003

(54) METHOD AND APPARATUS FOR VARIABLE RATE CODING OF SPEECH

(75) Inventor: Shihua Wang, Burlingame, CA (US)

(73) Assignee: Atmel Corporation, San Jose, CA (US)

( * ) Notice: Subject to any disclaimer, the term of this patent is extended or adjusted under 35 U.S.C. 154(b) by 0 days.

(21) Appl. No.: 09/421,435

(22) Filed: Oct. 19, 1999

(51) Int. Cl.[7] ..... G10L 19/08; G10L 19/10
(52) U.S. Cl. ..... 704/207; 704/223; 704/208
(58) Field of Search ..... 704/207, 208, 704/209, 212, 213, 214, 215, 216, 217, 218, 220, 221, 205, 223

(56) References Cited

U.S. PATENT DOCUMENTS

| | | | | |
|---|---|---|---|---|
| 4,701,954 A | | 10/1987 | Atal | 381/49 |
| 4,817,157 A | | 3/1989 | Gerson | 381/40 |
| 4,910,781 A | | 3/1990 | Ketchum et al. | 381/36 |
| 5,086,471 A | | 2/1992 | Tanaka et al. | 381/36 |
| 5,799,272 A | | 8/1998 | Zhu | 704/223 |
| 5,826,221 A | | 10/1998 | Aoyagi | 704/200 |
| 5,832,180 A | | 11/1998 | Nomura | 395/2.32 |
| 6,233,550 B1 | * | 5/2001 | Gersho et al. | 704/208 |
| 6,311,154 B1 | * | 10/2001 | Gersho et al. | 704/219 |

FOREIGN PATENT DOCUMENTS

EP 0 751 494 1/1997

OTHER PUBLICATIONS

Tian, W.S., Wong, W.C., Law, C.Y. and Tan, A.P., "Pitch Synchronus Extended Excitation In Multimode CELP", IEEE Communications Letters, vol. 3,No. 9,Sep. 1999,pp. 275–276.

Dervaux, F.,Gruet, C., and Delprat, M., "Performance And Optimization Of A GSM Half Rate Candidate" *U.S. Boston, Kluwer*, Jan. 1, 1993, pp. 93–99.

Paksoy, Erdal, Srinivasan, K., and Gersho, Allen, "Variable Rate Speech Coding With Phonetic Segmentation", Proceedings of ICASSP, Apr. 27, 1993, pp. II–155–158.

Atal, B.S., Cuperman V., and Gersho, A. (eds.), "Advances in Speech Coding," Wang, S. and Gersho, A., *Kluwer Academic Publishers*, 1991, pp. 225–234.

Wang, S., and Gersho, A., "Phonetically–Based Vector Excitation Coding of Speech at 3.6 kbps," Dept. of Electrical and Computer Engineering, Univ. of California, Santa Barbara, May 23, 1989.

Atal, B.S., "High–Quality Speech at Low Bit Rates: Multi–Pulse and Stochastically Excited Linear Predictive Coders," Proceedings of IEEE ICASSP 1986, pp. 1681–1684.

Schroeder, M.R. and Atal, B.S., "Code–Excited Linear Prediction (CELP): High–Quality Speech at Very Low Bit Rates," Proceedings IEEE ICASSP 1985, pp. 937–940.

Atal, B.S. and Remde, J.R., "A New Model of LPC Excitation for Producing Natural–Sounding Speech at Low Bit Rates," Proceedings of IEEE ICASSP 1982, pp. 614–617.

* cited by examiner

*Primary Examiner*—David D. Knepper
*Assistant Examiner*—Abul K. Azad
(74) *Attorney, Agent, or Firm*—Thomas Schneck

(57) ABSTRACT

A speech encoding method using analysis-by-synthesis includes sampling an input speech and dividing the resulting speech samples into frames and subframes. The frames are analyzed to determine coefficients for the synthesis filter. The subframes are categorized into unvoiced, voiced and onset categories. Based on the category, a different coding scheme is used. The coded speech is fed into the synthesis filter, the output of which is compared to the input speech samples to produce an error signal. The coding is then adjusted per the error signal.

12 Claims, 9 Drawing Sheets

METHOD AND APPARATUS FOR VARIABLE RATE CODING OF SPEECH

TECHNICAL FIELD OF THE INVENTION

The present invention relates generally to speech analysis and more particularly to an efficient coding scheme for compressing speech.

BACKGROUND ART

Speech coding technology has advanced tremendously in recent years. Speech coders in wire and wireless telephony standards such as G.729, G.723 and the emerging GSM AMR have demonstrated very good quality at a rate of about 8 kbps and lower. The U.S. Federal Standard coder further shows that good quality synthesized speech can be achieved at rates as low as 2.4 kbps.

While these coders fulfill the demand in the rapidly growing telecommunication market, consumer electronics applications are still lacking in adequate speech coders. Typical examples include consumer items such as answering machines, dictation devices and voice organizers. In these applications, the speech coder must provide good quality reproduction in order to gain commercial acceptance, and high compression ratios in order to keep storage requirements of the recorded material to a minimum. On the other hand, interoperability with other coders is not a requirement, since these devices are standalone units. Consequently, there is no need to adhere to a fixed bit rate scheme or to coding delay restrictions.

Therefore a need exists for a low bit rate speech coder capable of providing high quality synthesized speech. It is desirable to incorporate the loosened restrictions of standalone applications to provide a high quality, low cost coding scheme.

SUMMARY OF THE INVENTION

The speech encoding method of the present invention is based on analysis-by-synthesis and includes sampling a speech input to produce a stream of speech samples. The samples are grouped into a first set of groups (frames). Linear predictive coding (LPC) coefficients for a speech synthesis filter are computed from an analysis of the frames. The speech samples are further grouped into a second set of groups (subframes). These subframes are analyzed to produce coded speech. Each subframe is categorized into an unvoiced, voiced or onset category. Based on the category, a certain coding scheme is selected to encode the speech sample comprising the group. Thus, for unvoiced speech a gain/shape encoding scheme is used. If the speech is onset speech, a multi-pulse modeling technique is employed. For voiced speech, a further determination is made based on the pitch frequency of such speech. For low pitch frequency voiced speech, encoding is accomplished by the computation of a long term predictor plus a single pulse. For high pitch frequency voiced speech, the encoding is based on a series of pulses spaced apart by a pitch period.

BEST MODE FOR CARRYING OUT THE INVENTION

Figure 1:
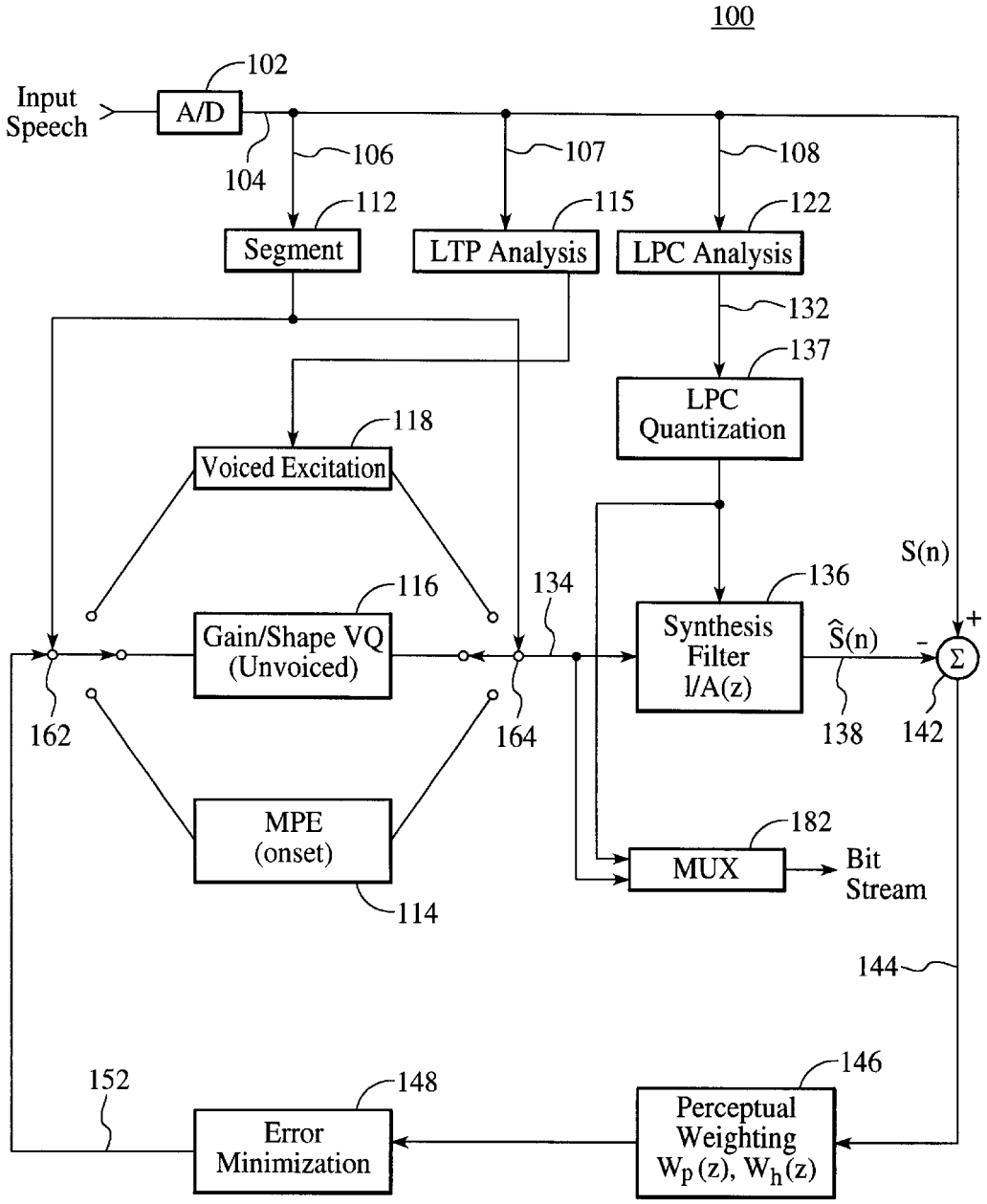
FIG. 1 is a high level block diagram of the processing elements in accordance with the invention.

In FIG. 1, a high level conceptual block diagram of the speech encoder 100 of the present invention shows an A/D converter 102 for receiving an input speech signal. Preferably, the A/D is a 16-bit converter with a sampling rate of 8000 samples per second, thus producing a stream of samples 104. A 32-bit decoder (or a lower resolution decoder) can be used of course, but a 16-bit word size was deemed to provide adequate resolution. The desired resolution will vary depending on cost considerations and desired performance levels.

The samples are grouped into frames and further into subframes. Frames of size 256 samples, representing 32 mS of speech, feed into a linear predictive coding (LPC) block 122 along path 108, and also feed into a long term prediction (LTP) analysis block 115 along path 107. In addition, each frame is divided into four subframes of 64 samples each which feed into a segmentation block 112 along path 106. The encoding scheme of the present invention, therefore, occurs on a frame-by-frame basis and at the subframe level.

As will be explained in further detail below, LPC block 122 produces filter coefficients 132 which are quantized 137 and which define the parameters of a speech synthesis filter 136. A set of coefficients is produced for each frame. The LTP analysis block 115 analyzes the pitch value of the input speech and produces pitch prediction coefficients which are supplied to the voiced excitation coding scheme block 118. Segmentation block 112 operates on a per subframe basis. Based on an analysis of a subframe, the segmentation block operates selectors 162 and 164 to select one of three excitation coding schemes 114–118 by which the subframe is coded to produce an excitation signal 134. The three excitation coding schemes, MPE (Onset excitation coding) 114, Gain/Shape VQ (unvoiced excitation coding) 116, and voiced excitation coding 118 will be explained in further detail below. The excitation signal feeds into synthesis filter 136 to produce synthesized speech 138.

In general, the synthesized speech is combined with the speech samples 104 by a summer 142 to produce an error signal 144. The error signal feeds into a perceptual weighting filter 146 to produce a weighted error signal which then feeds into an error minimization block 148. An output 152 of the error minimization block drives the subsequent adjustment of the excitation signal 134 to minimize the error.

When the error is adequately minimized in this analysis-by-synthesis loop, the excitation signal is encoded. The filter coefficients 132 and the encoded excitation signal 134 are then combined by a combining circuit 182 into a bitstream. The bitstream can then be stored in memory for later decoding, or sent to a remote decoding unit.

Figure 2:
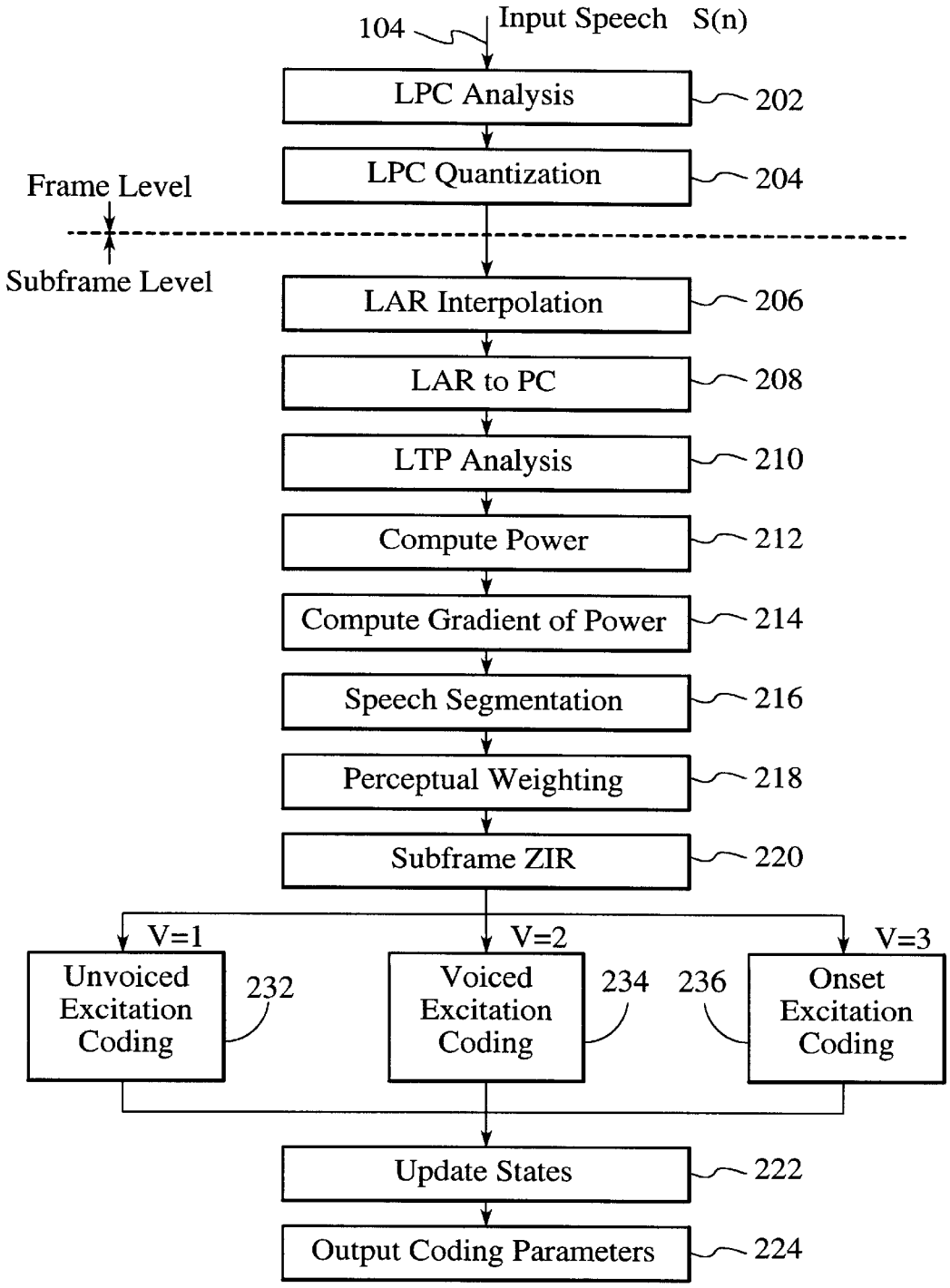
FIG. 2 is a flow chart showing the computational steps of the invention.
Figure 3A:
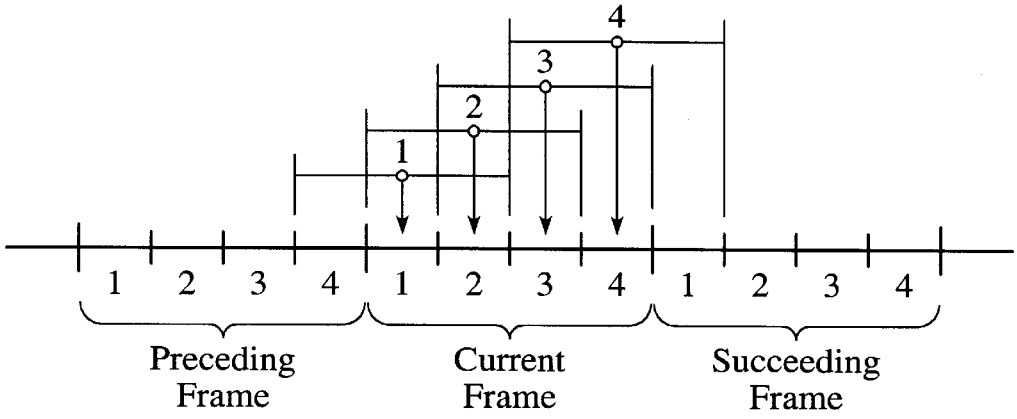
FIGS. 3A and 3B show the subframe overlapping for some of the computations shown in FIG. 2.

The description will now turn to a discussion of the encoding process in accordance with the preferred mode of the present invention as illustrated by the flow chart of FIG. 2. Processing begins with an LPC analysis 202 of the sampled input speech 104 on a frame-by-frame basis. In the preferred mode, a 10-th order LPC analysis is performed on input speech s(n) using an autocorrelation method for each subframe comprising a frame. The analysis window is set at 192 samples (three subframes wide) and is aligned with the center of each subframe. Truncation of the input samples to the desired 192 sample size is accomplished by the known technique of a Hamming window operator. Referring to FIG. 3A for a moment, it is noted that processing of the first subframe in a current frame includes the fourth subframe of the preceding frame. Likewise, processing the fourth subframe of a current frame includes the first subframe of the succeeding frame. This overlap across frames occurs by virtue of the three-subframe width of the processing window. The autocorrelation function is expressed as:

$$R(i) = \sum_{i=0}^{Na-1-i} s(n)s(n+i) \qquad \text{Eqn. 1}$$

where Na is 192.

The resulting autocorrelation vector is then subjected to bandwidth expansion, which involves multiplying the autocorrelation vector with a vector of constants. Bandwidth expansion serves to widen the bandwidth of forments and reduces bandwidth under-estimation.

It has been observed that for some speakers certain nasal speech sounds are characterized by a very wide spectral dynamic range. This is true also for some sine tones in DTMF signals. Consequently, the corresponding speech spectrum exhibits large sharp spectral peaks having very narrow bandwidths, producing undesirable results from the LPC analysis.

To overcome this aberration, a shaped noise correction vector is applied to the autocorrelation vector. This is as opposed to a white-noise correction vector used in other coders (such as G.729) which is equivalent to adding a noise floor at the speech spectrum. The noise correction vector has a V-shaped envelope and is scaled by the first element of the autocorrelation vector. The operation is shown in Eqn. 2:

$$\text{auto}lpc[i]=\text{auto}lpc[i]+\text{auto}lpc[\mathbf{0}]\cdot\text{Noiseshape}[i] \qquad \text{Eqn. 2}$$

where i=Np, . . . , 0 and Noiseshape[11]={.002,.0015,.001, .0005,0,0,0,0.0005,.001,.0015,.002}.

In the frequency domain, the noise correction vector corresponds to a rolling off shape spectrum, which means that the spectrum that has a roll-off at higher frequencies. Combining this spectrum with the original speech spectrum in the manner expressed in Eqn. 2 has the desired effect of reducing the spectrum dynamic range of the original speech and has the added benefit of not raising the noise floor at the higher frequencies. By scaling the autocorrelation vector with the noise correction vector, the spectra of the troublesome nasal sounds and sine tones can be extracted with greater accuracy, and the resulting coded speech will not contain undesirable audible high frequency noise due to the addition of a noise floor.

Finally, for the LPC analysis (step 202), the prediction coefficients (filter coefficients) for synthesis filter 136 are recursively computed according to the known Durbin recursive algorithm, expressed by Eqn. 3:

$$E^{(0)}=R(\mathbf{0})$$

$$k_i = \left[R(i) - \sum_{j=1}^{i-1} a_j^{(i-1)} R(i-j)\right] \Big/ E^{(i-1)} \quad 1 \le i \le N_p \qquad \text{Eqn. 3}$$

$$a_i^{(i)}=k_i;\ a_j^{(i)}=a_j^{(i-1)}-k_i a_{j-1}^{(i-1)};\ E^{(i)}=(1-k_i)E^{(i-1)} \quad 1\leqq j\leqq i-1$$
$$a_j=a_j^{(Np)} \quad 1\leqq j\leqq N_p$$

A set of prediction coefficients which constitute the LPC vector is produced for each subframe in the current frame. In addition, using known techniques, reflection coefficients ($RC_i$) for the fourth subframe are generated, and a value indicating the spectral flatness (sfn) of the frame is produced. The indicator $sfn=E^{(Np)}/R_0$ is the normalized prediction error derived from Eqn. 3.

Continuing with FIG. 2, the next step in the process is LPC quantization, step 204, of the LPC vector. This is performed once per frame, on the fourth subframe of each frame. The operation is made on the LPC vector of the fourth subframe in reflection coefficient format. First, the reflection coefficient vector is converted into the log area ratio (LAR) domain. The converted vector is then split into first and second subvectors. The components of the first subvector are quantized by a set of non-uniform scalar quantizers. The second subvector is sent to a vector quantizer having a codebook size of 256. The scalar quantizer requires less complexity in terms of computation and ROM requirements, but consumes more bits as compared to vector quantization. On the other hand, the vector quantizer can achieve higher coding efficiency at the price of increased complexity in the hardware. By combining both scalar and vector quantization techniques on the two subvectors, the coding efficiency can be traded off for complexity to obtain an average spectral distortion (SD) of 1.35 dB. The resulting codebook only requires 1.25 K words of storage.

To achieve a low coding rate, the prediction coefficients are updated only once per frame (every 32 mS). However, this update rate is not sufficient to maintain a smooth transition of the LPC spectrum trajectory from frame to frame. Thus, using known interpolation techniques, a linear interpolation of the prediction coefficients, step 206, is applied in the LAR domain to assure stability in synthesis filter 136. After the interpolation, the LAR vector is converted back to prediction coefficient format for direct form filtering by the filter, step 208.

Figure 3B:
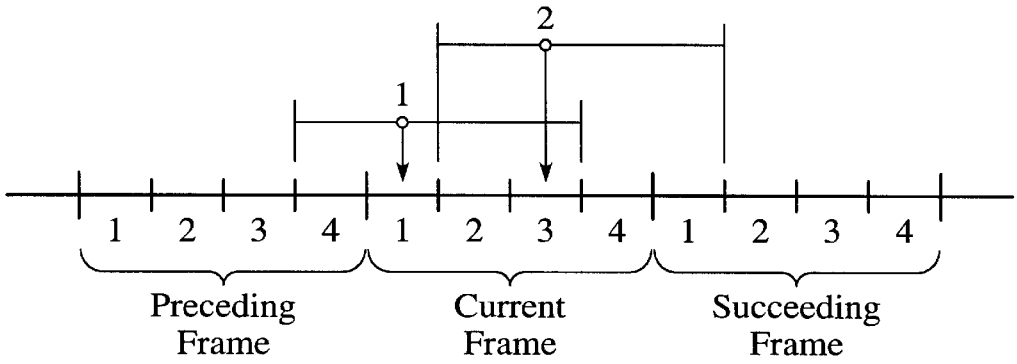

The next step shown in FIG. 2 is a long term prediction (LTP) analysis for estimating the pitch value of the input speech within two subframes in an open loop fashion, step 210. The analysis is performed twice per frame, once at the first subframe and again at the third subframe using a window size of 256 samples which is four subframes wide. Referring to FIG. 3B for a moment, it is noted that the analysis window is centered at the end of the first subframe and thus includes the fourth subframe of the preceding frame. Likewise, the analysis window is centered at the end of the third subframe and thus includes the first subframe of the succeeding frame.

Figure 4:
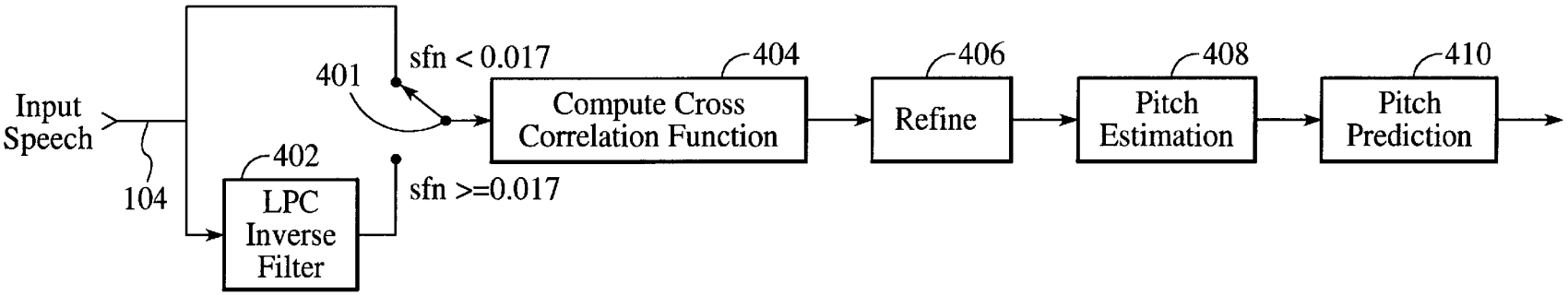
FIG. 4 is a flow chart of the processing steps for LTP analysis.

FIG. 4 shows the data flow for the LTP analysis step. Input speech samples are either processed directly or preprocessed through an inverse filter 402, depending on the spectral flatness indicator (sfn) computed in the LPC analysis step. Switch 401 which handles this selection will be discussed below. Continuing then, a cross correlation operation 404 is performed followed by a refinement operation 406 of the cross correlation result. Finally, a pitch estimation 408 is made, and pitch prediction coefficients are produced in block 410 for use in the perceptual weighting filter 146.

Returning to block 402, the LPC inverse filter is an FIR filter whose coefficients are the unquantized LPC coefficients computed for the subframe for which the LPC analysis is being performed, namely subframe 1 or subframe 3. An LPC residual signal res(n) is produced by the filter in accordance with Eqn. 4:

$$res(n) = sltp(n) - \sum_{i=1}^{N_p} a_i sltp(n-i) \quad \text{Eqn. 4}$$

where sltp[ ] is a buffer containing the sampled speech.

Usually, the input to the cross correlation block 404 is the LPC residual signal. However, for some nasal sounds and nasalized vowels, the LPC prediction gain is quite high. Consequently, the fundamental frequency is almost entirely removed by the LPC inverse filter so that the resulting pitch pulses are very weak or altogether absent in the residual signal. To overcome this problem, switch 401 feeds either the LPC residual signal or the input speech samples themselves to the cross correlation block 404. The switch is operated based on the value of the spectral flatness indicator (sfn) previously computed in step 202.

When the spectral flatness indicator is less than a predetermined threshold, the input speech is considered to be highly predictable and the pitch pulses tend to be weak in the residual signal. In such a circumstance, it is desirable to extract the pitch information directly from the input signal. In the preferred embodiment, the threshold value is empirically selected to be 0.017 as shown in FIG. 4.

The cross correlation function 404 is defined as:

$$cros[l] = \frac{\sum_{n=(N-l/2)}^{3N-l/2} res[n] \cdot res[n+l]}{\sqrt{\sum_{n=(N-l/2)}^{3N-l/2} res[n]^2 \sum_{n=(N+l/2)}^{3N+l/2} res[n+l]^2}}, \quad \text{Eqn. 5}$$

where l=L min−2, . . . L max+2

N=64

L min=20, minimum pitch lag value

L max=126, maximum pitch lag value

To improve the accuracy of the estimated pitch value, the cross correlation function is refined through an up-sampling filter and a local maximum search procedure, 406. The up-sampling filter is a 5-tap FIR with a 4× increased sampling rate, as defined in Eqn. 6:

$$cros_{up}[4l+i-1] = \sum_{j=2}^{2} cros[l+j] \cdot IntpTable(i, j) \quad 0 \le i \le 3 \quad \text{Eqn. 6}$$

where

IntpTable(0,j)=[−0.1286, 0.3001, 0.9003, −0.1801, 0.1000]

IntpTable(1,j)=[0,0,1,0,0]

IntpTable(2,j)=[0.1000, −0.1801, 0.9003, 0.3001, −0.1286]

IntpTable(3,j)=[0.1273, −0.2122, 0.6366, 0.6366, −0.2122]

The local maximum is then selected in each interpolated region around the original integer values to replace the previously computed cross correlation vector:

$$cros[l] = \max(cros_{up}[4l-1], cros_{up}[4l], cros_{up}[4l+1], cros_{up}[4l+2]) \quad \text{Eqn. 7}$$

where $L_{min} \leqq l \leqq L_{max}$

Next, a pitch estimation procedure 408 is performed on the refined cross correlation function to determine the open-loop pitch lag value Lag. This a involves first performing a preliminary pitch estimation. The cross correlation function is divided into three regions, each covering pitch lag values 20–40 (region 1 corresponding to 400 Hz–200 Hz), 40–80 (region 2, 200 Hz–100 Hz), and 80–126 (region 3, 100 Hz–63 Hz). A local maximum of each region is determined, and the best pitch candidate among the three local maxima is selected as $lag_v$, with preference given to the smaller lag values. In the case of unvoiced speech, this constitutes the open-loop pitch lag estimate Lag for the subframe.

For voicing subframes, a refinement of the initial pitch lag estimate is made. The refinement in effect smooths the local pitch trajectory relative to the current subframe thus providing the basis for a more accurate estimate of the open-loop pitch lag value. First, the three local maxima are compared to the pitch lag value ($lag_p$) determined for the previous subframe, the closest of the maxima being identified as $lag_h$ . If $lag_h$ is equal to the initial pitch lag estimate then the initial pitch estimate is used. Otherwise, a pitch value which results in a smooth pitch trajectory is determined as the final open-loop pitch estimate based on the pitch lag values $lag_v$, $lag_h$, $lag_p$ and their cross correlations. The following C language code fragment summarizes the process. The limits used in the decision points are determined empirically:

```
/*
    lagv-selected pitch lag value
    lagp-pitch lag value of previous subframe
    laghclosest of local maxima to lagp
    xmaxv-cross correlation of lagv
    xmaxp-cross correlation of lagp
    xmaxh-cross correlation of laghh
*/
diff = (lagv-laghh)/lagp;
/*
    choose lagp if lagv and laghh have low
    cross correlation values
*/
if( xmax, < 0.35 && xmaxh < 0.35) {
    lagv = lagp; xmaxv = cross__corr(lagp);
}
/*
    when lagv is much less than laghh and
    xmaxh is large, then choose laghh
*/
else if( diff < −0.2 ) {
    if( (xmaxh − xmxv) > .05 ) {
        lagv = laghh; xmaxv = xmaxh;
}
}
/*
    if lagv and laghh are close, then the one with
    the larger cross correlation value wins
*/
else if( diff < 0.2 ) {
    if( xmaxh > xmaxv ) {
        lagv = laghh; xmaxv = xmaxh;
}
}
/*
    if lag, is much greater than laghh and
    their cross correlation is close, choose laghh
/*
else if( abs(xmaxh − xmaxv) < 0.1 ){
    lagv = laghh; xmaxv = xmaxh;
}
```

The final step in the long term prediction analysis (step 210) is the pitch prediction block 410 which is executed to obtain a 3-tap pitch predictor filter based on the computed open-loop pitch lag value Lag using a covariance computation technique. The following matrix equation is used to compute the pitch prediction coefficients cov[i], i=0, 1, 2 which will be used in the perceptual weighting step below (step 218):

$$\begin{bmatrix} S0^tS0 & S0^tS1 & S0^tS2 \\ S0^tS1 & S1^tS1 & S1^tS2 \\ S0^tS2 & S1^tS2 & S2^tS2 \end{bmatrix} \begin{bmatrix} cov[0] \\ cov[1] \\ cov[2] \end{bmatrix} = \begin{bmatrix} b0 \\ b1 \\ b2 \end{bmatrix}$$

where $$S_i^tS_j = \sum_{n=pt1}^{pt1+2N-1} S(n+i)\cdot S(n+j) \quad i, j = 0, 1, 2 \qquad \text{Eqn. 8}$$

and $$bi = \sum_{n=pt1}^{pt1+2N-1} S(n+i)\cdot S(n+Lag+1) \quad i = 0, 1, 2$$

$$pt1 = N - Lag/2 - 1$$

Returning to FIG. 2, the next step is to compute the energy (power) in the subframe, step 212. The equation for the subframe energy (Pn) is:

$$Pn = \frac{1}{Np_n}\sum_{k=0}^{Np_n-1} s(k)^2 \qquad \text{Eqn. 9}$$

where $Np_n$=N, except in the following special cases:

$$Np_n = \begin{cases} 2\cdot Lag & Lag \le 40,\ cros[Lag] > 0.35 \\ \min(Lag, 2\cdot N) & Lag > 40,\ cros[Lag] > 0.35 \end{cases}$$

Next is the computation of the energy gradient (EG) of the subframe, step 214, expressed by Eqn. 10 as:

$$EG = \begin{cases} \dfrac{Pn - Pn_p}{Pn} & Pn > Pn_p \\ 0 & Pn \le Pn_p \end{cases} \qquad \text{Eqn. 10}$$

where $Pn_p$ is the previous subframe's energy.

The input speech is then categorized on a subframe basis into an unvoiced, voiced or onset category in the speech segmentation, step 216. The categorization is based on various factors including the subframe power computed in step 212 (Eqn. 9), the power gradient computed in step 214 (Eqn. 10), a subframe zero crossing rate, the first reflection coefficient ($RC_1$) of the subframe, and the cross correlation function corresponding to the pitch lag value previously computed in step 210.

The zero crossing rate (ZC) is determined from Eqn. 11:

$$ZC = \frac{1}{2N}\sum_{k=0}^{N-1} sgn(s(k)) - sgn(s(k-1)) \qquad \text{Eqn. 11}$$

where sgn(x) is the sign function. For voiced sounds, the signal contains fewer high frequency components as compared to unvoiced sound and thus the zero crossing rate will be low.

The first reflection coefficient (RC1) is the normalized autocorrelation of the input speech at a unit sample delay in the range (1, −1). This parameter is available from the LPC analysis of step 202. It measures the spectral tilt over the entire pass band. For most voiced sounds, the spectral envelope decreases with frequency and the first reflection coefficient will be close to one, while unvoiced speech tends to have a flat envelope and the first reflection coefficient will be close to or less than zero.

The cross correlation function (CCF) corresponding to the computed pitch lag value of step 210 is the main indicator of periodicity of the speech input. When its value is close to one, the speech is very likely to be voiced. A smaller value indicates more randomness in the speech, which is characteristic of unvoiced sound.

$$CCF = cros[\text{Lag}] \qquad \text{Eqn. 12}$$

Continuing with step 216, the following decision tree is executed to determine the speech category of the subframe, based on the above-computed five factors Pn, EG, ZC, RC1 and CCF. The threshold values used in the decision tree were determined heuristically. The decision tree is represented by the following code fragment written in the C programming language:

```
/*
    unvoiced category:      voicing <- 1
    voiced category:        voicing <- 2
    onset category:         voicing <- 3
*/
/* first, detect silence segments */
    if( PN < 0.002 ) {
        voicing = 1;
/* check for very low energy unvoiced speech segments */
    } else if( Pn < 0.005 && CCF < 0.4 ) {
        voicing = 1;
/* check for low energy unvoiced speech segments */
    } else if( Pn < 0.02 && ZC > 0.18 && CCF < 0.3) {
        voicing = 1;
/* check for low to medium energy unvoiced speech segments */
    } else if( Pn < 0.03 && ZC > 0.24 && CCF < 0.45) {
        voicing = 1;
/* check for medium energy unvoiced speech segments */
    } else if( Pn < 0.06 && ZC > 0.3 && CCF < 0.2 && RC1 < 0.55) {
        voicing = 1;
/* check for high energy unvoiced speech segments */
    } else if( ZC > 0.45 && RC1 < 0.5 && CCF < 0.4) {
        voicing = 1;
/* classify the rest as voiced segments */
    } else {
        voicing = 2;
    }
/* now, re-classify the above as an onset segment based on EG */
    if( Pn > 0.01 || CCF > 0.8) {
        if( voicing == 1 && EG > 0.8) voicing = 3;
        if( voicing == 2 && EG > 0.475 ) voicing = 3;
    }
/*
    identify the onset segments at voicing transition by
    considering the previous voicing segment, identified
    as voicing_old
*/
    if( voicing == 2 && voicing_old < 2 ) {
        if( Pn <= 0.01 )
            voicing = 1;
        else
            voicing = 3;
    }
```

Continuing with FIG. 2, the next step is a perceptual weighting to take into account the limitations of human hearing, step 218. The distortions perceived by the human ear are not necessarily correlated to the distortion measured by the mean square error criterion often used in the coding parameter selection. In the preferred embodiment of the invention, a perceptual weighting is carried out on each subframe using two filters in cascade. The first filter is a spectral weighting filter defined by:

$$W_p(z) = \frac{1 - \sum_{i=1}^{N_p} a_i \lambda_N^i z^{-i}}{1 - \sum_{i=1}^{N_p} a_i \lambda_D^i z^{-i}} \quad \text{Eqn. 13}$$

where $a_i$ are the quantized prediction coefficients for the subframe; $\lambda_N$ and $\lambda_D$ are empirically determined scaling factors 0.9 and 0.4 respectively.

The second filter is a harmonic weighting filter defined by:

$$W_h(z) = 1 - \sum_{i=0}^{2} cov[i] \lambda_p z^{-(Lag+i-1)} \quad \text{Eqn. 14}$$

where the cov[i], i=0, 1, 2 coefficients were computed in Eqn. 8 and $\lambda_p$=0.4 is a scaling factor. For unvoiced sound, in which the harmonic structure is absent, the harmonic weighting filter is turned off.

Next in step 220, a target signal r[n] for subsequent excitation coding is obtained. First, a zero input response (ZIR) to the cascaded triple filter comprising synthesis filter 1/A(z), the spectral weighting filter $W_p(z)$, and the harmonic weighting filter $W_h(z)$ is determined. The synthesis filter is defined as:

$$\frac{1}{A(Z)} = \frac{1}{1 - \sum_{i=1}^{N_p} aq_i Z^{-i}}$$

where $aq_i$ is the quantized LPC coefficients for that subframe. The ZIR is then subtracted from a perceptually weighted input speech. This is illustrated more clearly in FIG. 5, which shows a slightly modified version of the conceptual block diagram of FIG. 1, reflecting certain changes imposed by implementation considerations. For example, it can be seen that the perceptual weighting filter 546 is placed further upstream in the processing, prior to summation block 542. The input speech s[n] is filtered through perceptual filter 546 to produce a weighted signal, from which the zero input response 520 is subtracted in summation unit 522 to produce the target signal r[n]. This signal feeds into error minimization block 148. The excitation signal 134 is filtered through the triple cascaded filters ($H(z)=1/A(z)\times W_p(z)\times W_h(z)$) to produce synthesized speech sq[n], which feeds into error minimization unit 148. The details of the processing which goes on in the error minimization block will be discussed in connection with each of the coding schemes.

The discussion will now turn to the coding schemes used by the invention. Based on the speech category of each subframe as determined in step 216, the subframe is coded using one of three coding schemes, steps 232, 234 and 236.

Figure 5:
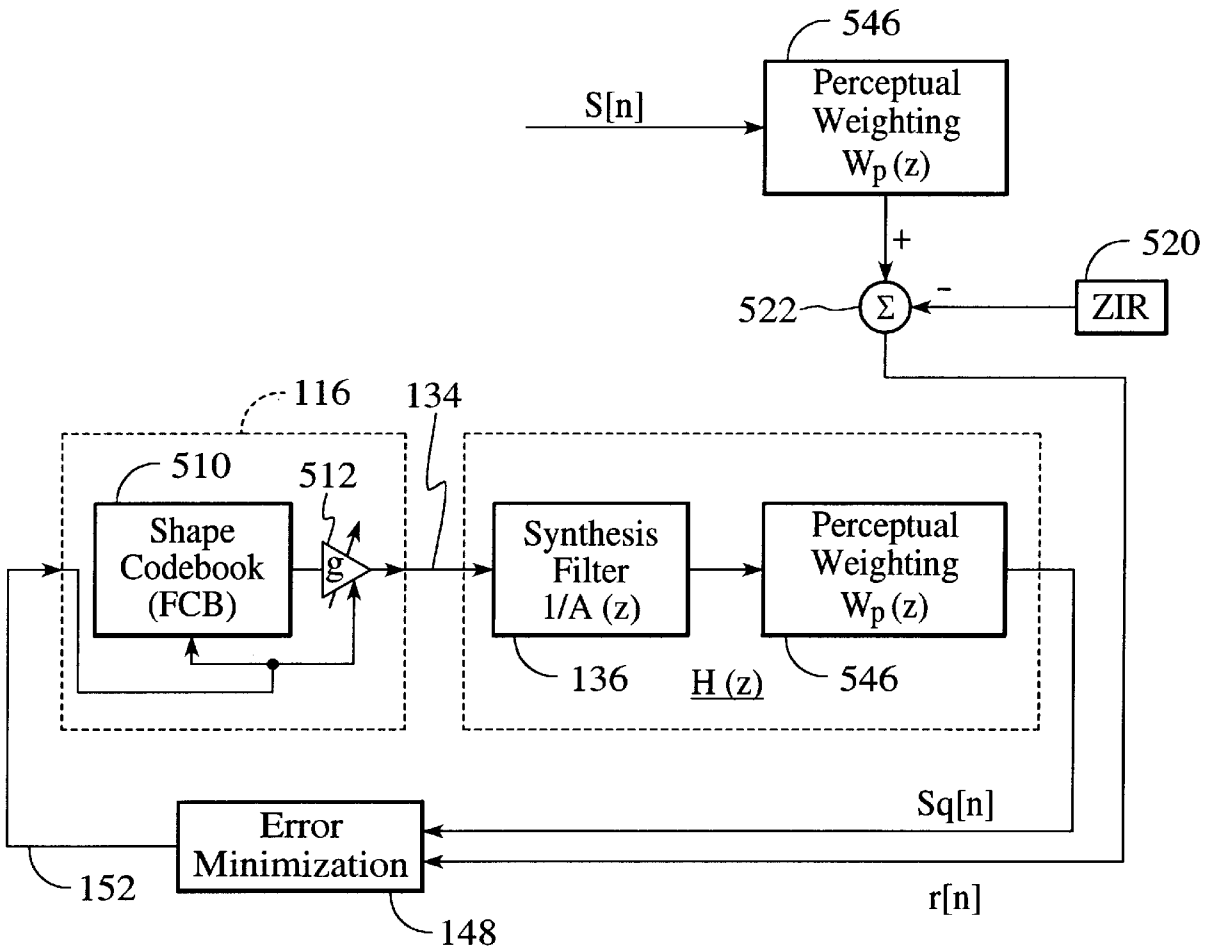
FIGS. 5–7 show the various coding schemes of the invention.

Referring to FIGS. 1, 2 and 5, consider first the coding scheme for unvoiced speech (voicing=1), step 232. FIG. 5 shows the configuration in which the coding scheme (116) for unvoiced speech has been selected. The coding scheme is a gain/shape vector quantization scheme. The excitation signal is defined as:

$$g \cdot fcb_i[n] \quad \text{Eqn. 15}$$

where g is the gain value of gain unit 520, $fcb_i$ is the $i^{th}$ vector selected from a shape codebook 510. The shape codebook 510 consists of sixteen 64-element shape vectors generated from a Gaussian random sequence. The error minimization block 148 selects the best candidate from among the 16 shape vectors in an analysis-by-synthesis procedure by taking each vector from shape codebook 510, scaling it through gain element 520, and filtering it through the synthesis filter 136 and perceptual filter 546 to produce a synthesized speech vector sq[n]. The shape vector which maximizes the following term is selected as the excitation vector for the unvoiced subframe:

$$\frac{(r^T sq)^2}{sq^T sq} \quad \text{Eqn. 16a}$$

This represents the minimum weighted mean square error between the target signal r[n] and the synthesized vector sq[n].

The gain g is computed by:

$$g = \text{scale}\sqrt{\frac{Pn^2 \cdot RS}{fcb_i^T fcb_i}} \quad \text{Eqn. 16b}$$

where Pn is the subframe power computed above, RS is:

$$RS = \prod_{i=1}^{N_p} (1 - rc_i^2) \quad \text{Eqn. 16c}$$

and scale=max(0.45, 1−max($RC_1$,0))

The gain is encoded through a 4-bit scalar quantizer combined with a differential coding scheme using a set of Huffman codes. If the subframe is the first unvoiced subframe encountered, the index of the quantized gain is used directly. Otherwise, a difference between the gain indices for the current subframe and the previous subframe is computed and represented by one of eight Huffman codes. The Huffman code table is:

| index | delta | Huffman code |
|---|---|---|
| 0 | 0 | 0 |
| 1 | 1 | 10 |
| 2 | −1 | 110 |
| 3 | 2 | 1110 |
| 4 | −2 | 11110 |
| 5 | 3 | 111110 |
| 6 | −3 | 1111110 |
| 7 | 4 | 1111111 |

Using the above codes, the average code length for coding the unvoiced excitation gain is 1.68.

Figure 6:
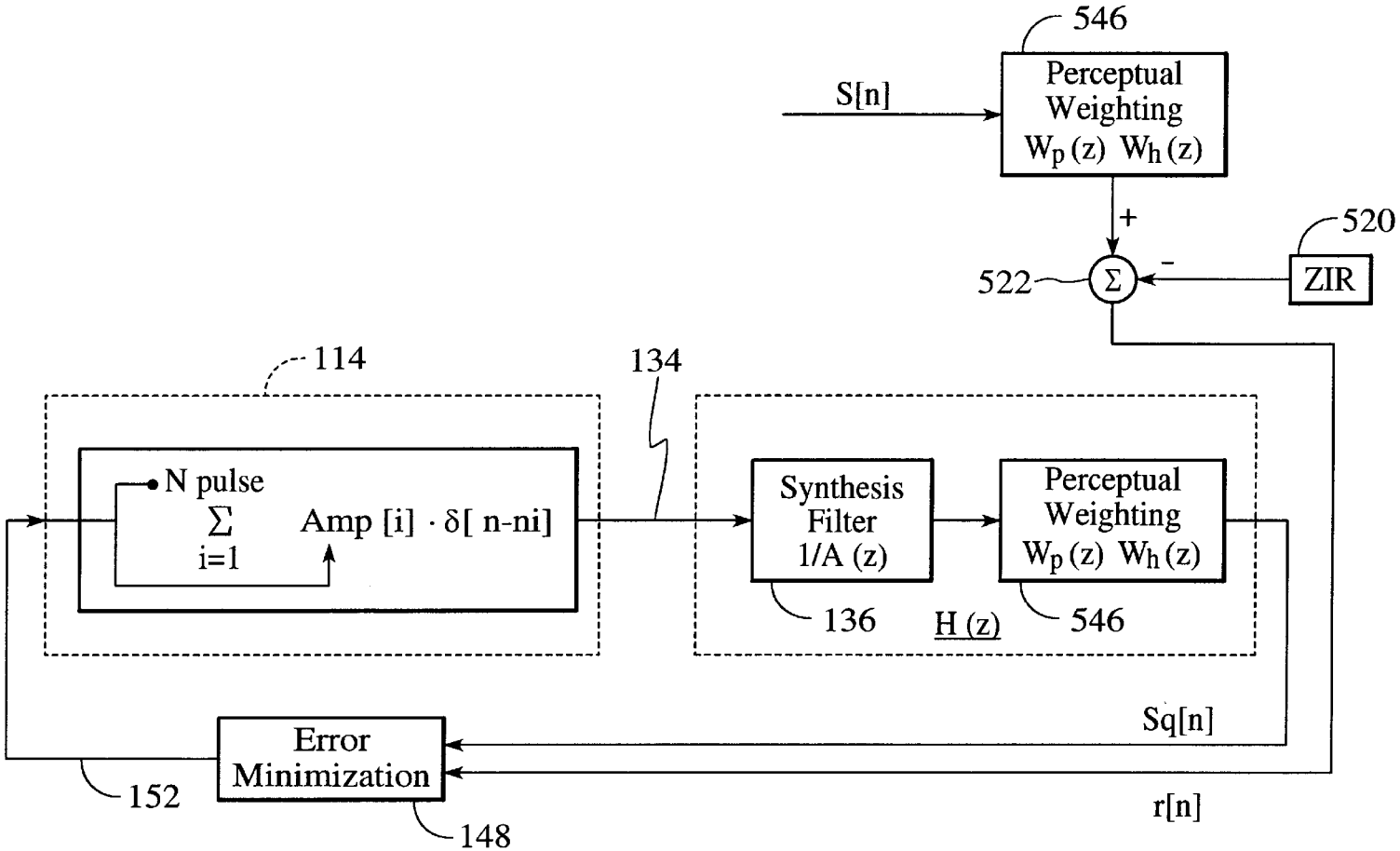

Referring now to FIG. 6, consider the treatment of onset speech segments. During onset, the speech tends to have a sudden energy surge and is weakly correlated with the signal from the previous subframe. The coding scheme (step 236) for subframes categorized as onset speech (voicing=3) is based on a multipulse excitation modeling technique wherein the excitation signal comprises a set of pulses derived from the current subframe. Hence, $$\sum_{i=1}^{Npulse} Amp[i] \cdot \delta[n - n_i] \quad \text{Eqn. 17}$$

where Npulse is the number of pulses, Amp[i] is the amplitude of the $i^{th}$ pulse, and $n_i$ is the location of the $i^{th}$ pulse. It has been observed that a proper selection of the location of the pulses allows this technique to capture the sudden energy change in the input signal that characterizes onset speech. An advantage of this coding technique as applied to onset speech is that it exhibits quick adaptation and the number of pulses is much smaller than the subframe size. In the preferred embodiment of the invention, four pulses are used to represent the excitation signal for coding of onset speech.

The following analysis-by-synthesis procedure is followed to determine the pulse locations and the amplitude. In determining the pulses, the error minimization block 148 examines only the even-numbered samples of the subframe. The first sample is selected which minimizes:

$$\sum_n [r[n] - Amp[0] \cdot h[n - n_0]]^2 \quad \text{Eqn. 18a}$$

where r[n] is the target signal and h[n] is the impulse response 610 of the cascade filter H(z). The corresponding amplitude is computed by:

$$Amp[0] = \frac{r^T h_{n_o}}{h_{n_o}^T h_{n_o}} \quad \text{Eqn. 18b}$$

Next, the synthesized speech signal sq[n] is produced using the excitation signal, which at this point comprises a single pulse of a given amplitude. The synthesized speech is subtracted from the original target signal r[n] to produce a new target signal. The new target signal is subjected to Eqns. 18a and 18b to determine a second pulse. The procedure is repeated until the desired number of pulses is obtained, in this case four. After all the pulses are determined, a Cholesky decomposition method is applied to jointly optimize the amplitudes of the pulses and improve the accuracy of the excitation approximation.

The location of a pulse in a subframe of 64 samples can be encoded using five bits. However, depending on the speed and space requirements, a trade-off between coding rate and data ROM space for a look-up table may improve coding efficiencies. The pulse amplitudes are sorted in descending order of their absolute values and normalized with respect to the largest of the absolute values and quantized with five bits. A sign bit is associated with each absolute value.

Figure 7:
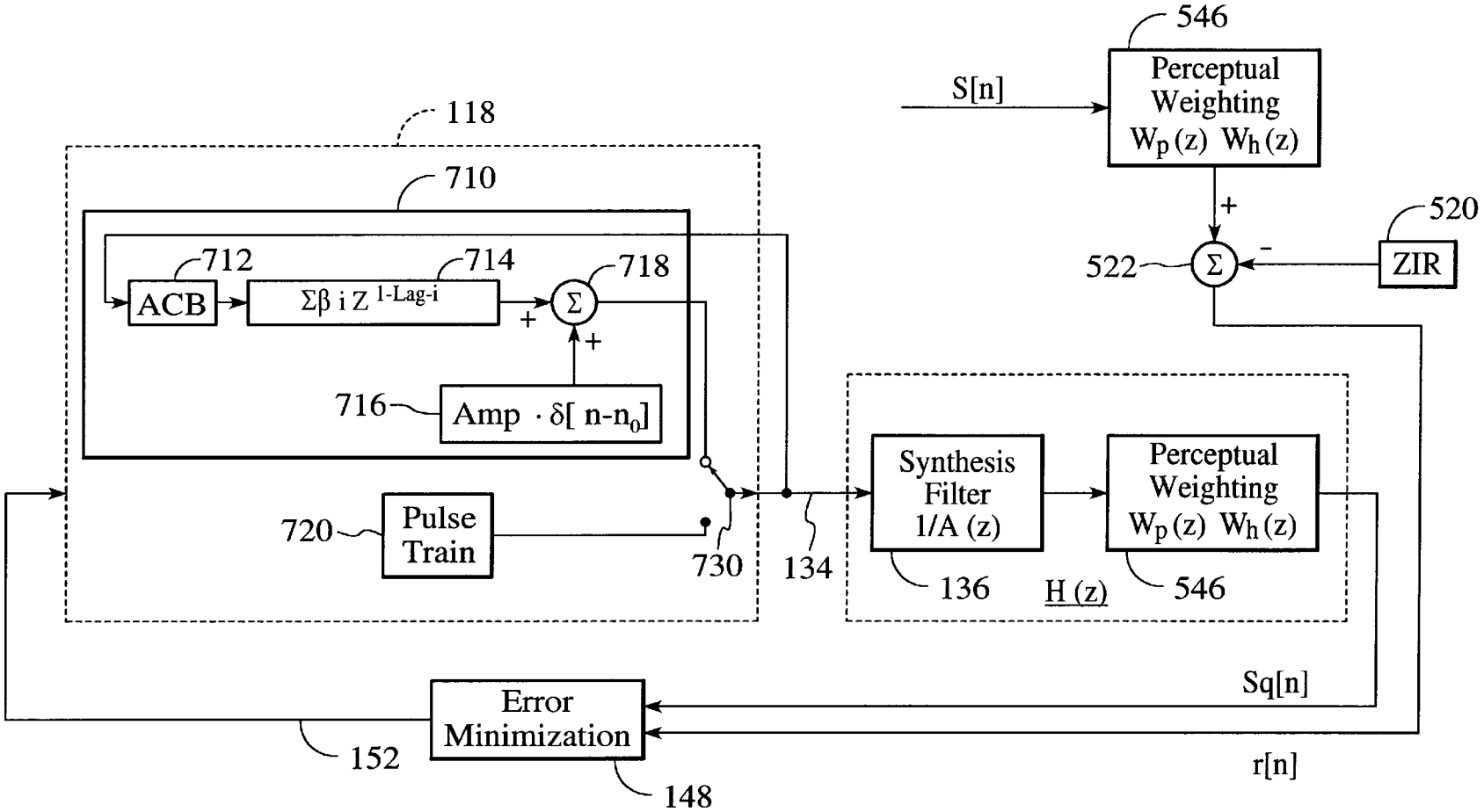

Refer now to FIG. 7 for voiced speech. The excitation model for voiced segments (voicing=2, step 234) is divided into two parts 710 and 720, based on the closed-loop pitch lag value $Lag_{CL}$. When the lag value $Lag_{CL}$>=58, the subframe is considered to be low-pitched sound and selector 730 selects the output of model 710, otherwise the sound is deemed to be high-pitched and the excitation signal 134 is determined based on model 720.

Consider first low-pitched voiced segments in which the waveform tends to have a low time domain resolution. A third order predictor 712, 714 is used to predict the current excitation from the previous subframe's excitation. A single pulse 716 is then added at the location where a further improvement to the excitation approximation can be achieved. The previous excitation is extracted from an adaptive codebook (ACB) 712. The excitation is expressed as:

$$\left(\sum_{i=0}^{2} \beta_i \cdot P_{ACB}[n, Lag_{CL} + i - 1]\right) + Amp \cdot \delta[n - n_0] \quad \text{Eqn. 19a}$$

The vector $P_{ACB}$[n, j] is selected from code book 712 which is defined as:

When $$Lag_{CL}+i-1>=N,$$

$$P_{ACB}[n, Lag_{CL}+i-1]=ex[n-(Lag_{CL}+i-1)] \quad 0 \leq n \leq N-1 \quad \text{Eqn. 19b}$$

Otherwise, $$P_{ACB}[n, Lag_{CL} + i - 1] = \begin{cases} ex[n - (Lag_{CL} + i - 1)] & 0 \leq n < Lag_{CL} \\ ex[n - 2 \cdot (Lag_{CL} + i - 1)] & Lag_{CL} \leq n \leq N - 1 \end{cases} \quad \text{Eqn. 19b}$$

For the high-pitched voiced segments, the excitation signal defined by model 720 consists of a pulse train defined by:

$$Amp \sum_{i=0}^{\left\lfloor \frac{N}{Lag_{CL}} \right\rfloor} \delta[n - n_0 - i \cdot Lag_{CL}] \quad \text{Eqn. 20}$$

The model parameters are determined by one of two analysis-by-synthesis loops, depending on the closed-loop pitch lag value Lag. The closed loop pitch $Lag_{CL}$ for the even-numbered subframes is determined by inspecting the pitch trajectory locally centered about the open-loop Lag computed as part of step 210 (in the range Lag−2 to Lag+2). For each lag value in the search range, the corresponding vector in adaptive codebook 712 is filtered through H(z). The cross correlation between the filtered vector and target signal r[n] is computed. The lag value which produces the maximum cross correlation value is selected as the closed loop pitch lag $Lag_{CL}$. For the odd-numbered subframes, the $Lag_{CL}$ value of the previous subframe is selected.

If $Lag_{CL}$>=58, the 3-tap pitch prediction coefficients $\beta_i$ are computed using Eqn. 8 and $Lag_{CL}$ as the lag value. The computed coefficients are then vector quantized and combined with a vector selected from adaptive codebook 712 to produce an initial predicted excitation vector. The initial excitation vector is filtered through H(z) and subtracted from input target r[n] to produce a second input target r'[n]. Using the technique for multipulse excitation modeling above (Eqns. 18a and 18b), a single pulse $n_0$ is selected from the even-numbered samples in the subframe, as well as the pulse amplitude Amp.

In the case where Lag<58, parameters for modeling high-pitched voiced segments are computed. The model parameters are the pulse spacing $Lag_{CL}$, the location $n_0$ of the first pulse, and the amplitude Amp for the pulse train. $Lag_{CL}$ is determined by searching a small range around the open-loop pitch lag, [Lag−2, Lag+2]. For each possible lag value in this search range, a pulse train is computed with pulse spacings equal to the lag value. Then shift the first pulse locations in the subframe and filter the shifted pulse train vector through H(z) to produce synthesized speech sq[n]. The combination of lag value and initial location which results in a maximum cross correlation between the shifted and filtered version of the pulse train and the target signal r[n] is selected as $Lag_{CL}$ and $n_0$. The corresponding normalized cross correlation value is considered as the pulse train amplitude Amp.

For Lag>=58, $Lag_{CL}$ is coded with seven bits and is only updated once every other subframe. The 3-tap predictor coefficients $\beta_i$ are vector quantized with six bits, and the single pulse location is coded with five bits. The amplitude value Amp is coded with five bits: one bit for the sign and four bits for its absolute value. The total number of bits used for the excitation coding of low-pitched segments is 20.5.

For Lag<58, $Lag_{CL}$ is coded with seven bits and is updated on every subframe. The initial location of the pulse train is coded with six bits. The amplitude value Amp is coded with five bits: one bit for the sign and four bits for its absolute value. The total number of bits used for the excitation coding of high-pitched segments is 18.

When the excitation signal is selected per one of the foregoing techniques, the memory of filters 136 (1/A(z)) and 146 ($W_p(z)$ and $W_h(z)$) are updated, step 222. In addition, adaptive codebook 712 is updated with the newly determined excitation signal for processing of the next subframe. The coding parameters are then output to a storage device or transmitted to a remote decoding unit, step 224.

Figure 8:
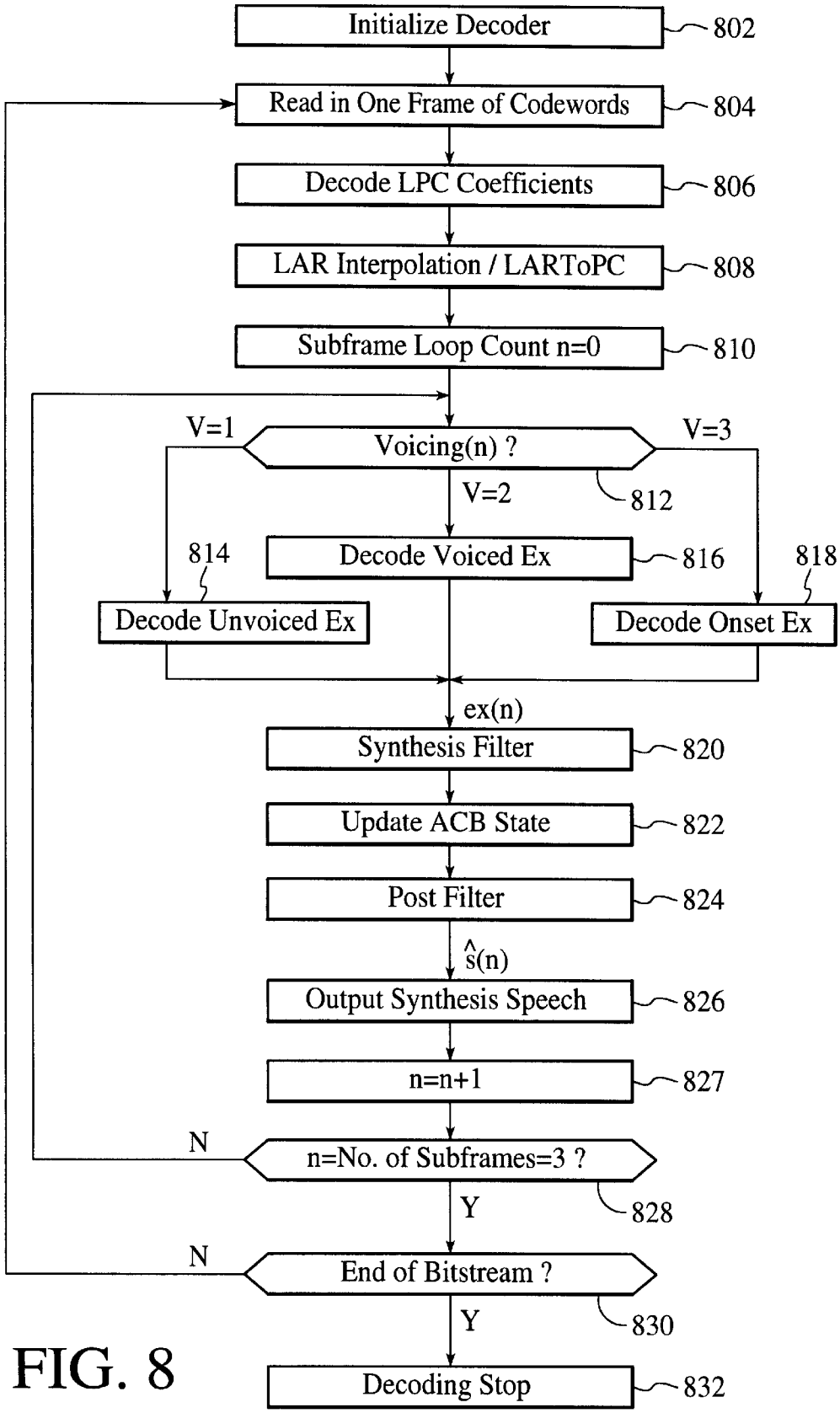
FIG. 8 is a flow chart of the decoding process.

FIG. 8 illustrates the decoding process. First, the LPC coefficients are decoded for the current frame. Then, depending on the voicing information of each subframe, the decoding of excitation for one of the three speech categories is executed. The synthesized speech is finally obtained by filtering the excitation signal through the LPC synthesis filter.

After the decoder is initialized, step 802, one frame of codewords is read into the decoder, step 804. Then, the LPC coefficients are decoded, step 806.

The step of decoding of LPC (in LAR format) coefficients is in two stages. First, the first five LAR parameters from the LPC scalar quantizer codebooks are decoded:

$$LAR[i]=LPCSQ\text{Table}[i][rx\text{Codewords}\rightarrow LPC[i]] \quad \text{Eqn. 21a}$$

where i=0, 1, 2, 3, 4.

Then, the remaining LAR parameters from LPC Vector quantizer codebook are decoded:

$$LAR[5,9]=LPCVQ\text{Table}[0,4][rx\text{Codewords}\rightarrow LPC[5]] \quad \text{Eqn. 21b}$$

After the decoding of the 10 LAR parameters, an interpolation of the current LPC parameter vector with the previous frame's LPC vector is performed using known interpolation techniques and the LAR is converted back to prediction coefficients, step 808. The LAR can be converted back to prediction coefficients via two steps. First, the LAR parameters are converted back to reflection coefficients as follows:

$$rc[i] = \frac{1-\exp(LAR[i])}{1+\exp(LAR[i])} \quad \text{Eqn. 22a}$$

Then, the prediction coefficients are obtained through the following equations:

$$a_i^{(i)}=k_i$$

$$a_j^{(i)}=a_j^{(i-1)}-k_i a_{j-1}^{(i-1)} 1\leq j\leq i-1$$

$$a_j=a_j^{(N_p)} 1\leq j\leq N_p \quad \text{Eqn. 22b}$$

After the LAR is converted back to prediction coefficients, the subframe loop count is set to n=0, step 810. Then, step 812, it is determined for each subframe into which of the three coding schemes is the subframe to be categorized, as the decoding for each coding scheme is different.

Figure 9:
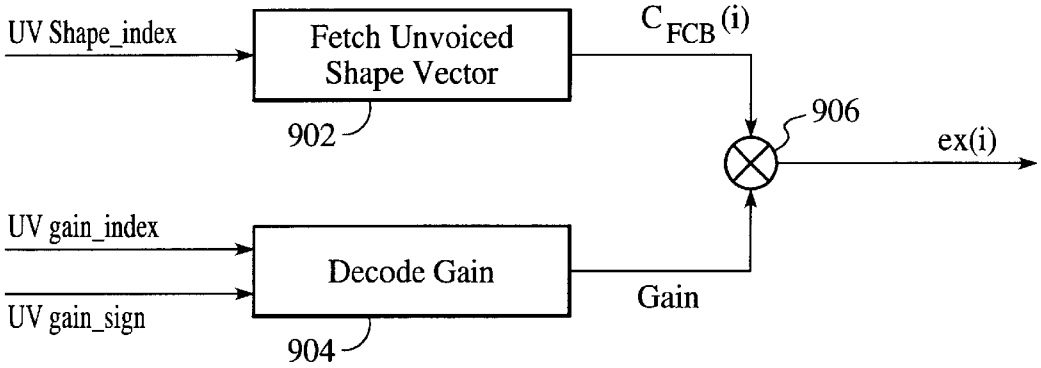
FIG. 9 is a block diagram of the decoding scheme for unvoiced excitation.

If the voicing flag of the current subframe indicates an unvoiced subframe (v=1), the unvoiced excitation is decoded, step 814. With reference to FIG. 9, first the shape vector is fetched 902 in the fixed codebook FCB with the decoded index:

$$C_{FCB}[i]=FCB[UV\text{shape-code}[n]][i] i=0, \ldots, N$$

Then, the gain of the shape vector is decoded 904 according to whether the subframe is the first unvoiced subframe or not. If it is the first unvoiced subframe, the absolute gain value is decoded directly in the unvoiced gain codebook. Otherwise, the absolute gain value is decoded from the corresponding Huffman code. Finally, the sign information is added to the gain value 906 to produce the excitation signal 908. This can be summarized as follows:

```
Gain_code = rxCodewords.Uvgain_code[n]
if (previous subframe is unvoided) {
Δ = HuffmanDecode[Gain_code]
Gain_code = Gain_code_p + Δ
}
Gain_code_p = Gain_code
Gain = Gain_sign * UVGAINCBTABLE[Gain_code]
```

Referring back to FIG. 8, when the subframe is a voiced subframe (v=2), to decode the voiced excitation, step 816, first the lag information is extracted. For even numbered subframes, the lag value is obtained in rxCodewords.ACB_code[n]. For odd numbered subframes, depending on the lag value of the previous subframe, Lag_p, either the current lag value is substituted with Lag_p if Lag_p>=58 or the lag value is extracted from rxCodewords.ACB_code[n] if Lag_p<58. Then, the single pulse is reconstructed from its sign, location, and the absolute amplitude value. If the lag value Lag>=58, the decoding of the ACB vector continues. First, the ACB gain vector is extracted from ACBGAINTable:

$$ACB_gainq[i]=ACBGAINCB\text{Table}[rx\text{Codewords}.ACBGain_\text{index}[n]][i]$$

Then, the ACB vector is reconstructed from the ACB state in the same fashion as in described with reference to FIG. 7 above. After the ACB vector is computed, the decoded single pulse is inserted in its defined location. If the lag value Lag<58, the pulse train is constructed from the decoded single pulse as described above.

Figure 10:
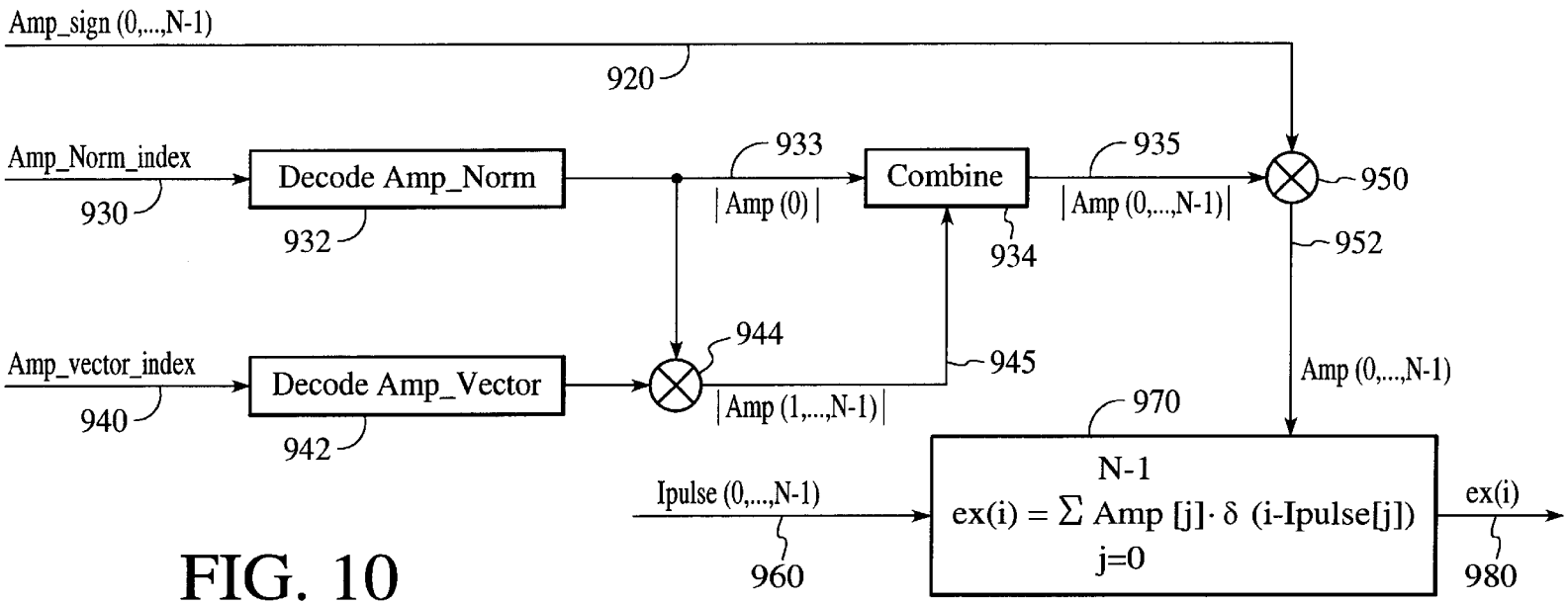
FIG. 10 is a block diagram of the decoding scheme for onset excitation.

If the subframe is onset (v=3), then the excitation vector is reconstructed from the decoded pulse amplitudes, sign, and location information. With reference to FIG. 10, the norm of the amplitudes 930, which is also the first amplitude, is decoded 932 and combined at multiplication block 944 with the decoded 942 of the rest of the amplitudes 940. The combined signal 945 is combined again 934 with the decoded first amplitude signal 933. The resultant signal 935 is multiplied with the sign 920 at multiplication block 950. Then, the resultant amplitude signal 952 is combined with the pulse location signal 960 according to the expression:

$$ex(i) = \sum_{j=0}^{N-1} Amp[j]\delta(i - Ipulse[j]) \quad \text{Eqn. 23}$$

to produce the excitation vector ex(i) 980. If the subframe is an even number, the lag value in the rxCodewords is also extracted for the use of the following voiced subframe.

Referring back to FIG. 8, the synthesis filter, step 820, can be in a direct form as an IIR filter, where the synthesized speech can be expressed as:

$$y[n] = ex[n] + \sum_{i=1}^{N_p} \alpha_i \cdot y[n-i] \quad \text{Eqn. 24}$$

To avoid computations in converting LAR (Log Area Ratio) parameters into predictor coefficients in the decoder, a lattice filter can be used as the synthesis filter and the LPC quantization table can be stored in RC (Reflection Coefficients) format in the decoder. The lattice filter also has an advantage of being less sensitive to finite precision limitations.

Next, step 822, the ACB state is updated for every subframe with the newly computed excitation signal ex[n] to maintain a continuous most recent excitation history. Then, the last step of the decoder processing, step 824, is the post filtering. The purpose of performing post filtering is to utilize the human masking capability to reduce the quantization noise. The post filter used in the decoder is a cascade of a pole-zero filter and a first order FIR filter:

$$H_p(Z) = \frac{1 - \sum_{i=1}^{N_p} a_i \gamma_N^i Z^{-1}}{1 - \sum_{i=1}^{N_p} a_i \gamma_D^i Z^{-1}} \cdot (1 - \gamma Z^{-1}) \quad \text{Eqn. 25}$$

where ai is the decoded prediction coefficients for the subframe. The scaling factors are $\gamma_N$=0.5, $\gamma_D$=0.8, and $\gamma$=0.4.

This results in a synthesized speech output 826. Then, the number (n) of the subframe loop count is increased by one, step 827, to indicate that one subframe loop has been completed. Then, a determination is made, step 828, of whether the number (n) of the subframe loop count is equal to 3, indicating that four loops (n=0, 1, 2, 3) have been completed. If n is not equal to 3, then the subframe loop is repeated from the step 812 of determining the categorization of the coding scheme. If n is equal to 3, then a determination is made, step 830, whether it is the end of the bitstream. If it is not the end of the bitstream, the entire process begins again with the step 804 of reading in another frame of codewords. If it is the end of the bitstream then the decoding process is finished 832.

What is claimed is:

1. A method for coding speech comprising the steps of:

sampling an input speech to produce a plurality of speech samples;

determining coefficients for a speech synthesis filter, including grouping said speech samples into a first set of groups and computing LPC coefficients for each such group, whereby said filter coefficients are based on said LPC coefficients;

producing excitation signals, including:

grouping said speech samples into a second set of groups;

categorizing each group in said second group into an unvoiced, voiced or onset category; and for each group in said unvoiced category, producing said excitation signals based on a gain/shape coding scheme;

for each group in said voiced category, producing said excitation signal by further categorizing such group into a low-pitch voiced group or a high-pitched voice group, wherein for low-pitched voice groups said excitation signals are based on a long term predictor and a single pulse, and for high-pitched voice groups said excitation signals are based on a sequence of pulses which are spaced apart by a pitch period;

for each group in said onset category, producing said excitation signals by selecting at least two pulses from said group; and encoding said excitation signals.

2. The method of claim 1 further including feeding said excitation signals into said speech synthesis filter to produce a synthesized speech, producing error signals by comparing said input speech with said synthesized speech, and adjusting parameters of said excitation signals based on said error signals.

3. The method of claim 2 wherein said speech synthesis filter includes a perceptual weighting filter, whereby said error signal includes the effects of the perception system of a human listener.

4. The method of claim 1 wherein said step of categorizing each group in said second set of groups is based on said group's computed energy, energy gradient, zero crossing rate, first reflection coefficient, and cross correlation value.

5. The method of claim 1 further including interpolating LPC coefficients between successive groups in said first set of groups.

6. A method for coding speech comprising the steps of:

sampling an input speech signal to produce a plurality of speech samples;

dividing said samples into a plurality of frames, each frame including two or more subframes;

computing LPC coefficients for a speech synthesis filter for each frame, whereby said filter coefficients are updated on a frame-by-frame basis;

categorizing each subframe into an unvoiced, voiced or onset category;

computing parameters representing an excitation signal for each subframe on the basis of its category, wherein for said unvoiced category a gain/shape coding scheme is used, wherein for said voiced category said parameters are based on a pitch frequency of said subframe, and wherein for said onset category a multi-pulse excitation model is used, and wherein computing parameters for voiced category subframes includes determining a pitch frequency, and for low-pitch frequency voiced-category subframes said parameters are based on a long term predictor and a single pulse, and for high-pitch frequency voiced-category subframes said parameters are based on a sequence of pulses which are spaced apart by a pitch period; and adjusting said parameters by feeding said excitation signal into said speech synthesis filter to produce a synthesized speech, producing an error signal by comparing said synthesized speech with said speech samples, and updating said parameters on the basis of said error signal.

7. The method of claim 6 wherein said step of computing LPC coefficients includes interpolating successive ones of said LPC coefficients.

8. The method of claim 6 wherein said speech synthesis filter includes a perception weighting filter and said speech samples are filtered through said perception weighting filter.

9. The method of claim 6 wherein said step of categorizing is based on said subframe's computed energy, energy gradient, zero crossing rate, first reflection coefficient, and cross correlation value.

10. Apparatus for coding speech, comprising:

a sampling circuit having an input for sampling an input speech signal and having an output for producing digitized speech samples;

a memory coupled to said sampling circuit for storing said samples, said samples being organized into a plurality of frames, each frame being divided into a plurality of subframes;

first means having access to said memory for computing a set of LPC coefficients for each frame, each set of coefficients defining a speech synthesis filter;

second means having access to said memory for computing parameters of excitation signals for each subframe;

third means for combining said LPC coefficients with said parameters to produce synthesized speech; and fourth means operatively coupled to said third means for adjusting said parameters based on comparisons between said digitized speech samples and said synthesized speech;

said second means including:

fifth means for categorizing each subframe into an unvoiced, voiced or onset category;

sixth means for computing said parameters based on a gain/shape coding technique if said subframe is of the unvoiced category;

seventh means for computing said parameters based on a pitch frequency of said subframe if it is of the voiced category, said seventh means when said pitch frequency is a low-pitched frequency, computing the parameters based on a long-term predictor and a single pulse and than when said pitch frequency is a high-pitched frequency, computing the parameters based on a sequence of pulses spaced apart by a pitch period; and eighth means for computing said parameters based on a multi-pulse excitation model if said subframe is of the onset category.

11. The apparatus of claim 10 wherein said fourth means includes means for computing error signals and means for adjusting said error signals by a perceptual weighting filter, whereby said parameters are adjusted based on weighted error signals.

12. The apparatus of claim 10 wherein said first means includes means for interpolating between successive ones of said LPC coefficients.

* * * * *